US012660885B2

(12) United States Patent
Roux et al.

(10) Patent No.: US 12,660,885 B2
(45) Date of Patent: Jun. 23, 2026

(54) OPERATING DEVICE FOR A SPORTS SHOE OR BOOT

(71) Applicant: ROSSIGNOL LANGE S.R.L., Montebelluna (IT)

(72) Inventors: Pascal Roux, Saint-Egrève (FR); Bertrand Barre, Lyons (FR); Francesco Giacca, Montebelluna (IT); Paolo Cima, Volpago del Montello (IT)

(73) Assignee: ROSSIGNOL LANGE S.R.L., Montebelluna (IT)

( * ) Notice: Subject to any disclaimer, the term of this patent is extended or adjusted under 35 U.S.C. 154(b) by 73 days.

(21) Appl. No.: 18/363,494

(22) Filed: Aug. 1, 2023

(65) Prior Publication Data

US 2024/0041162 A1 Feb. 8, 2024

(30) Foreign Application Priority Data

Aug. 5, 2022 (EP) ..... 22425034

(51) Int. Cl.
*A43C 11/14* (2006.01)
*A43B 5/04* (2006.01)

(52) U.S. Cl.
CPC ..... *A43C 11/1473* (2013.01); *A43B 5/048* (2013.01); *A43B 5/0435* (2013.01); (Continued)

(58) Field of Classification Search
CPC ..... A43B 5/046; A43B 5/0452; A43B 5/0435; A43B 5/048; A43C 11/14; A43C 11/1406; (Continued)

(56) References Cited

U.S. PATENT DOCUMENTS 3,570,148 A * 3/1971 Morgan ..... A43B 5/0435 36/118.8
3,722,112 A * 3/1973 Morgan ..... A43B 13/08 36/118.8

(Continued)

FOREIGN PATENT DOCUMENTS

EP 1743542 A1 1/2007
EP 1915917 A1 4/2008

(Continued)

OTHER PUBLICATIONS

European Search Report and Written Opinion dated Dec. 16, 2022 in priority application No. EP22425034.0; with English machine translation (total 18 pages).

*Primary Examiner* — Alissa J Tompkins
*Assistant Examiner* — Dakota Marin
(74) *Attorney, Agent, or Firm* — Seckel IP, PLLC

(57) ABSTRACT

Operating device (5) for a sports shoe/boot (1), including:—a tightening device (6) intended to tighten the sports shoe/boot around a foot or lower leg of a user;—a first lever (14) able to move between a first position and a second position, the first lever being able to actuate the tightening;
device; and—a second lever (15) distinct from the first lever (14), the second lever (15) being able to move between a first position and a second position, the second lever being intended to actuate at least one accessory (10) of the sports, shoe/boot, the first lever and the second lever being configured to rest one upon the other.

26 Claims, 5 Drawing Sheets

(52) U.S. Cl.
CPC ..... *A43B 5/0452* (2013.01); *A43B 5/046* (2013.01); *A43C 11/14* (2013.01); *A43C 11/1406* (2013.01); *A43C 11/1413* (2013.01); *A43C 11/142* (2013.01); *A43C 11/1433* (2013.01); *A43C 11/144* (2013.01); *A43C 11/1446* (2013.01); *A43C 11/146* (2013.01); *A43C 11/148* (2013.01); *Y10T 24/2106* (2015.01); *Y10T 24/2142* (2015.01); *Y10T 24/216* (2015.01); *Y10T 24/2183* (2015.01); *Y10T 24/2192* (2015.01); *Y10T 24/4072* (2015.01)

(58) Field of Classification Search
CPC ..... A43C 11/1413; A43C 11/142; A43C 11/1473; A43C 11/146; A43C 11/148; A43C 11/144; A43C 11/1446; A43C 11/1433; A43C 11/007; Y10T 24/2183; Y10T 24/2106; Y10T 24/216; Y10T 24/2142; Y10T 24/2192; Y10T 24/4072
USPC ..... 36/50.5; 24/68 SK, 69 SK, 70 SK, 24/71 SK, 191, 311
See application file for complete search history.

(56) References Cited

U.S. PATENT DOCUMENTS 3,793,749 A * 2/1974 Gertsch ..... A43B 5/0449 36/117.6
4,112,557 A * 9/1978 Salomon ..... A43C 11/1413 24/69 SK
4,349,971 A * 9/1982 Everest, III ..... A43B 5/0474 36/118.7
4,539,763 A * 9/1985 Walkhoff ..... A43B 5/0449 36/118.1
4,669,202 A * 6/1987 Ottieri ..... A43B 1/0018 36/118.5
4,672,755 A 6/1987 Benoit et al.
4,811,503 A * 3/1989 Iwama ..... A43B 5/0447 36/118.1
5,005,302 A * 4/1991 Bischof ..... A43B 5/0433 36/117.8
5,136,794 A * 8/1992 Stampacchia ..... A43B 5/0474 36/118.8
5,203,098 A * 4/1993 Perrissoud ..... A43B 5/0452 36/118.8
5,224,281 A * 7/1993 Nerrinck ..... A43B 5/048 36/118.8
5,333,363 A 8/1994 Artusi et al.
5,526,555 A * 6/1996 Battistella ..... A43C 11/1406 24/71 SK
5,592,722 A * 1/1997 Foscaro ..... A43C 11/1413 24/69 ST
5,779,259 A * 7/1998 Lin ..... A43C 11/1466 280/623
5,974,633 A * 11/1999 Sartor ..... A43C 11/1433 24/71 SK
6,347,436 B1 * 2/2002 Barber ..... A43C 11/1406 24/71 SK
6,708,425 B2 * 3/2004 Parisotto ..... A43B 5/0456 36/117.4
6,739,615 B1 * 5/2004 Maravetz ..... A63C 10/10 280/14.22
8,458,860 B2 * 6/2013 Fregoni ..... A43C 11/1453 24/71 SK
8,763,209 B2 * 7/2014 Kavarsky ..... A43C 11/1413 24/70 SK
9,538,805 B2 * 1/2017 Tronchin ..... A43C 11/00
10,206,459 B2 * 2/2019 Grandin ..... A43C 11/142
10,531,703 B2 * 1/2020 Venturato ..... A43B 5/047
10,595,592 B2 * 3/2020 Posato ..... A43C 11/14
11,202,486 B2 * 12/2021 Lee ..... A43B 5/002
11,918,079 B2 * 3/2024 Parisotto ..... A43C 11/1493
2008/0172907 A1 * 7/2008 Sartor ..... A43B 5/0474 36/118.4
2012/0297591 A1 * 11/2012 Bozzetto ..... A43C 11/146 24/191
2017/0042279 A1 * 2/2017 Parisotto ..... A43B 5/0488
2017/0105488 A1 * 4/2017 Grandin ..... A43C 11/1426
2017/0238650 A1 * 8/2017 Battilana ..... A43B 5/047
2021/0212411 A1 * 7/2021 Gannat ..... A43B 5/0409
2021/0368908 A1 * 12/2021 Drynan ..... A43B 5/0435

FOREIGN PATENT DOCUMENTS

FR 2564327 11/1985
FR 2688983 A1 10/1993

* cited by examiner

OPERATING DEVICE FOR A SPORTS SHOE OR BOOT

This application claims priority of European patent application No. EP22425034.0 filed Aug. 5, 2022, the content of which is hereby incorporated by reference herein in its entirety.

TECHNICAL FIELD OF THE INVENTION

The invention relates to the field of operating devices configured to tighten a sports shoe/boot around a foot or lower leg of a user. In particular, the invention relates to a ski boot comprising such an operating device.

BACKGROUND ART

Sports shoes/boots need both to be comfortable and to allow optimal transmission of impulse from their users. When participating in sport, it is commonplace for phases of relatively intense activity to alternate with weighting or resting phases. The sought-after compromise between the comfort and the performance of sports shoes/boots generally differs according to the phase of use of the sports shoe/boot.

For example, for skiing, users require ski boots that are rigid and fitted tightly around their feet and lower legs when descending snow-covered ski-runs. By contrast, when they are walking around or waiting at mechanical ski lifts, users are more inclined towards comfort.

In order to allow the various different compromises between performance in use and comfort, sports shoes/boots equipped with tightening means that are easy to manipulate are known. In particular, ski boots are generally equipped with tightening buckles connected to a first lever that can be rotated between a closed position and an open position. Ski boots equipped with a device for locking and unlocking the rotation articulation between a lower shell and a cuff, commonly known by the name "ski-walk" are also known. The locking and unlocking device can be actuated via a second lever able to move between a first configuration referred to as the ski configuration, and a second configuration referred to as a walk configuration. The rotation articulation is blocked when the locking device is in the ski configuration but on the other hand released when the locking device is in a walk configuration.

Sports shoes/boots known from the prior art thus require numerous manipulation actions between the various phases of participating in a sport in order to obtain the desired level of performance or comfort. Because of these diverse manipulations, it is often the case that the sports shoes/boots are not used correctly. In particular, in the case of ski boots, users often ski on snowy ski runs with the rotation articulation between the lower shell and the cuff left unlocked. This happens all the more often when, in the case of certain ski boots or for certain users, the blocking or releasing of the rotation articulation is not readily perceivable. Users who forget to lock the rotation articulation have greater difficulty in guiding their skis, leading to a risk of falling and sustaining injury.

Thus, to simplify the manipulation thereof, ski boots equipped with a lever configured to actuate both a means for tightening the sports shoe/boot and a device for locking and unlocking the rotation articulation between a lower shell and a cuff are known, notably from publications EP1915917 or FR2688983: when the user actuates this lever said user acts both on the tightening of the boot/shoe and on the locking and unlocking device. However, such devices are complex and do not fully meet users' expectations.

SUMMARY OF THE INVENTION

It is an object of the invention to provide an operating device for a sports shoe/boot that overcomes the above disadvantages and improves the sports shoe/boot tightening devices known from the prior art.

More specifically, a first subject of the invention is an operating device for a sports shoe/boot that is both easy and intuitive to manipulate and allows the user to achieve the best compromise between performance and comfort for each situation.

The invention relates to a sports shoe/boot comprising a lower shell intended to envelop a foot of a user, a cuff intended to envelop a lower leg of the user, and a rotation articulation between the lower shell and the cuff, the sports shoe/boot further comprising an operating device comprising:

- a tightening means configured to tighten the cuff around the lower leg of the user and/or to tighten the lower shell around the foot of the user,
- a first lever able to move between a first position and a second position, the first lever being able to actuate the tightening means, the first lever comprising at least one manipulation surface configured to allow a user to move the first lever between its first position to its second position,
- a locking device locking the rotation articulation between the lower shell and the cuff
- a second lever, distinct from the first lever, the second lever being able to move between a first position and a second position, the second lever being intended to actuate said locking device, the second lever comprising at least one manipulation surface configured to allow the user to move the second lever between its first position to its second position, the second lever being connected to the locking device such that:
- when the second lever is in its first position, the rotation articulation between the lower shell and the cuff is locked, and
- when the second lever is in its second position, the rotation articulation between the lower shell and the cuff is released, the first lever and the second lever being configured to rest one upon the other such that:
- when the first lever is in its first position, the second lever is automatically in its first position, and
- when the second lever is in its second position, the first lever is automatically in its second position.

The first lever partially can cover the second lever when the first lever and the second lever are in their first position.

The tightening means can be in a configuration of tightly holding the foot or the lower leg of the user when the first lever is in its first position, and it can be in a configuration of releasing the foot or the lower leg of the user when the first lever is in its second position.

The first lever and the second lever can be able to rotate about the one same axis of rotation. The second lever can comprise a bow provided with two branches extending parallel to one another and the first lever can extend at least partly between the two branches of the second lever.

The first lever can comprise a bow provided with two branches extending parallel to one another, the two branches of the first lever being arranged between the two branches of the second lever, the tightening means comprising a tightening buckle able to engage with a catch and a connecting means fixed to the first lever and to the tightening buckle, said connecting means extending between the two branches of the first lever.

The second lever can comprise a housing inside which the first lever is positioned when the first lever is in its first position, and/or the first lever can comprise a housing inside which the second lever is positioned when the first lever is in its first position.

The first lever can be able to rotate about a first axis of rotation and the tightening means can comprise a tightening buckle fixed to the first lever about a second axis of rotation distinct from the first axis of rotation.

The second lever can be able to rotate about a first axis of rotation and the operating device can comprise a wire intended to actuate said sports shoe/boot locking device, the wire being fixed to the second lever at a point distinct from the axis of rotation.

The sports shoe/boot can have three configurations of operation:

- a first configuration corresponding to the first position of the first lever and of the second lever,
- a second configuration corresponding to the second position of the first lever and the first position of the second lever, and
- a third configuration corresponding to the second position of the first lever and of the second lever.

The first lever can comprise a first manipulation surface configured to allow a user to move the first lever from its second position to its first position, and a second manipulation surface configured to allow the user to move the first lever from its first position to its second position.

The second lever can comprise a first manipulation surface configured to allow the user to move the second lever from its second position to its first position, and a second manipulation surface configured to allow the user to move the second lever from its first position to its second position.

The sports shoe/boot can further comprise a pressing element able to move between a first position and a second position, the pressing element being intended to apply pressure to the foot or the lower leg of the user when it is in its first position, the pressing element being intended to adopt a retracted position relative to the foot or to the lower leg of the user when it is in its second position, the second lever being connected to the pressing element such that:

- when the second lever is in its first position, the pressing element is in its first position, and
- when the second lever is in its second position, the pressing element is in its second position. The operating device can be fixed to a wall of the sports shoe/boot, and the first lever can extend against the wall or against the second lever when it is in its first position, the first lever comprising a manipulation surface configured to allow the user to move the first lever from its first position to its second position, the manipulation surface of the first lever being positioned so that it is spaced away from said wall or from the second lever when the first lever is in its first position.

The second lever can extend against a wall or against the first lever when it is in its first position, the second lever comprising a manipulation surface that is configured to allow the user to move the second lever from its first position to its second position, the manipulation surface of the second lever being positioned so that it is spaced away from said wall or from the first lever when the second lever is in its first position.

The sports shoe/boot can be a ski boot.

The invention also relates to a sports shoe/boot comprising a lower shell intended to envelop a foot of a user, a cuff intended to envelop a lower leg of the user, and a rotation articulation between the lower shell and the cuff, the sports shoe/boot further comprising an operating device comprising:

- a tightening means configured to tighten the cuff around the lower leg of the user and/or to tighten the lower shell around the foot of the user,
- a first lever able to move between a first position and a second position, the first lever being able to actuate the tightening means, the first lever comprising at least one manipulation surface configured to allow a user to move the first lever between its first position to its second position,
- a pressing element able to move between a first position and a second position,
- a second lever, distinct from the first lever, the second lever being able to move between a first position and a second position, the second lever being intended to actuate said mobile pressing element, the second lever comprising at least one manipulation surface configured to allow the user to move the second lever between its first position to its second position, the second lever being connected to the mobile pressing element such that:
- when the second lever is in its first position, the pressing element presses against the foot or the lower leg of the user, and
- when the second lever is in its second position, the pressing element adopts a retracted position relative to the foot or the lower leg of the user, the first lever and the second lever being configured to rest one upon the other such that:
- when the first lever is in its first position, the second lever is automatically in its first position, and
- when the second lever is in its second position, the first lever is automatically in its second position.

The invention also relates to an operating device for a sports shoe/boot comprising:

- a tightening means intended to tighten the sports shoe/boot around a foot or lower leg of a user,
- a first lever able to move between a first position and a second position, the first lever being able to actuate the tightening means, the first lever comprising at least one manipulation surface configured to allow a user to move the first lever between its first position to its second position,
- a second lever distinct from the first lever, the second lever being able to move between a first position and a second position, the second lever being intended to actuate at least one accessory of the sports shoe/boot, said accessory being distinct from a means for tightening the shoe/boot around the foot or the lower leg of the user, said accessory being intended to make it easier for the user to walk, the second lever comprising at least one manipulation surface configured to allow the user to move the second lever between its first position to its second position, the first lever and the second lever being configured to rest one upon the other such that:
- when the first lever is in its first position, the second lever is automatically in its first position, and
- when the second lever is in its second position, the first lever is automatically in its second position.

BRIEF DESCRIPTION OF THE DRAWINGS

The objects, features and advantages of the present invention will be explained in detail in the following description of two particular embodiments given by way of nonlimiting example with reference to the attached figures among which.

DETAILED DESCRIPTION OF PARTICULAR EMBODIMENTS

Figure 1:
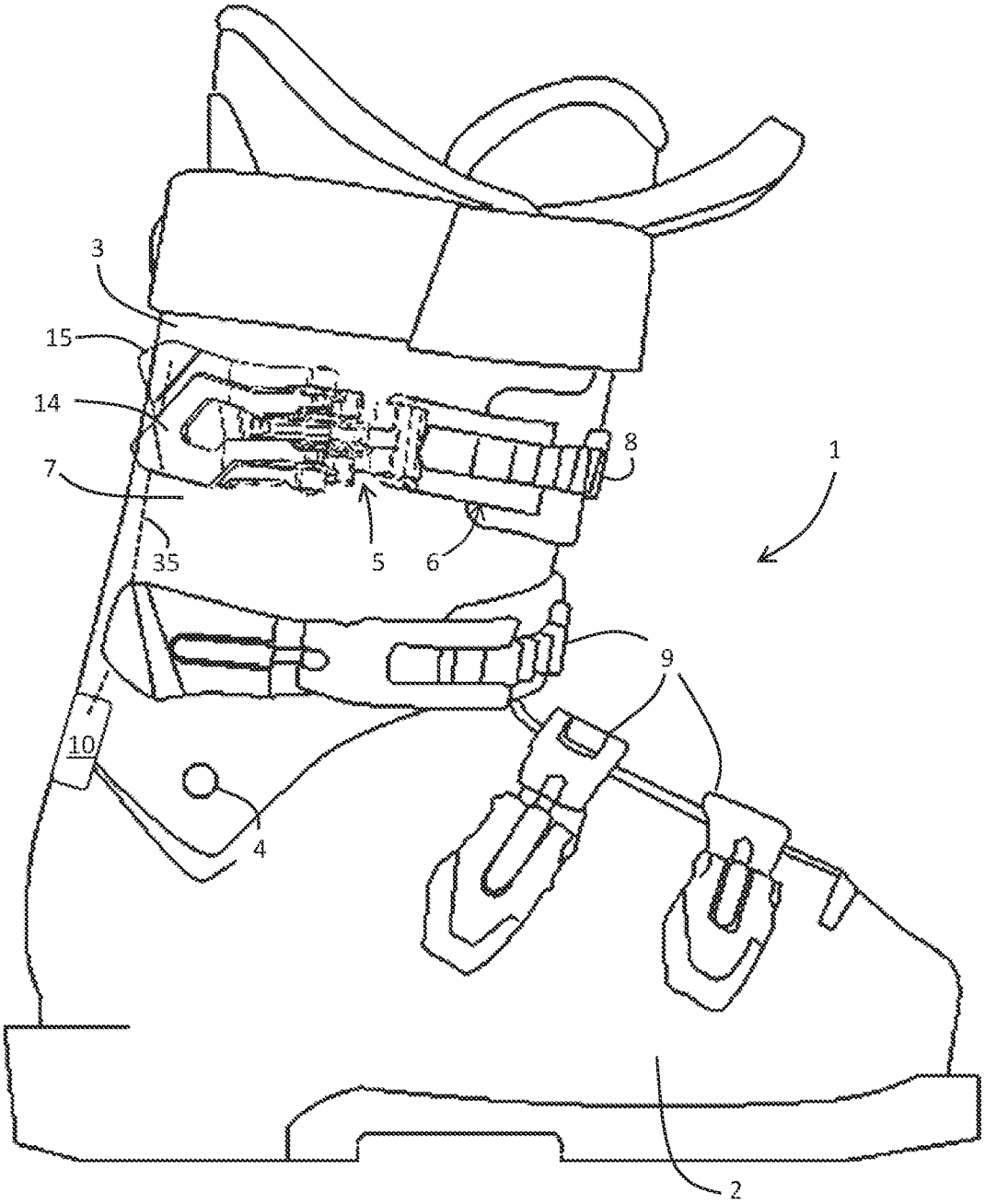
FIG. 1 is a schematic side view of the ski boot equipped with an operating device according to one embodiment of the invention.

FIG. 1 schematically illustrates a sports shoe/boot 1 according to one embodiment of the invention. In particular, the sports shoe/boot 1 is a ski boot. The ski boot may notably be designed for alpine skiing and/or for ski touring. As a variant, the sports shoe/boot could also be a shoe/boot designed for cross-country skiing, snowboarding, and more generally any gliding sport on snowy terrain. The ski boot comprises a lower shell 2 intended to envelop a foot of the user, a cuff 3 intended to envelop a lower leg of the user and a rotation articulation 4 between the lower shell 2 and the cuff 3. The rotation articulation 4 comprises an axis of rotation which extends substantially at the level of the ankle bones of the user so as to allow the flexure of the ankle. The ski boot further comprises at least one operating device 5 according to one embodiment of the invention.

The operating device 5 comprises a tightening means 6 intended to tighten the shoe/boot around the foot or the lower leg of the user. In particular, according to the embodiment described, the tightening means 6 is configured to tighten the cuff 3 of the ski boot around the lower leg. The operating device 5 is fixed to a wall 7 of the cuff 3. In particular, the wall 7 of the cuff forms a first flap of the cuff. The tightening means 6 collaborates with a catch, notably a tooth catch 8 arranged on a second flap of the cuff. The tightening means 6 thus, when in a tightened configuration, allows the two flaps of the cuff to be pulled closer together thereby allowing the cuffs to be tightened around the lower leg of the user. The user is thus able to effectively transmit impulses from themself to a gliding board fixed to the ski boot. The tightening means 6 is able to move between its tightened configuration and a released configuration in which the two flaps are further apart from one another, making it possible to relieve the compression of the lower leg, and also making stepping in and inserting the foot into the boot easier. As an alternative, the tightening means 6 can also be configured to tighten the lower shell 2 around the foot of the user. As is clearly visible in FIG. 1, the ski boot may also comprise additional tightening devices 9, which may be standard tightening means of the prior art or else tightening means integrated into an operating device according to the invention. The additional tightening means 9 may be used to supplement the tightening means 6 according to the invention. Advantageously, the tightening means 6 of the operating device 5 is positioned above the additional tightening means 9. The tightening means 6 is thus most easily accessible to the user. In particular, the cuff 3 comprises a standard tightening device 9 and an operating device 5 positioned above the standard tightening device.

The ski boot further comprises a locking device 10 locking the rotation articulation 4 of the cuff on the lower shell. The locking device is able to lock, which is to say block, the rotation articulation 4 when this device is in a first configuration, referred to as the ski configuration, and is able to release the rotation articulation 4 when it is in a second configuration, referred to as the walk configuration. By way of example, the locking device 10 may comprise a latch articulated relative to the cuff. When the locking device 10 is in its first configuration, the latch is able to collaborate with an opening or with a relief arranged in the lower shell in order to block the rotation articulation 4. When the locking device is in its second configuration, the latch is able to adopt a retracted position relative to said opening or to said relief so as to release the rotation articulation 4.

The locking device 10 constitutes an accessory of the ski boot which accessory is intended to make walking easier when in its walk configuration. As an alternative or in addition, the ski boot could comprise other accessories comprising an element able to move between a first position and a second position. According to one embodiment which has not been depicted, the ski boot may comprise a pressing element able to move between a first position and a second position. The pressing element is then intended to press against the foot or the lower leg of the user when it is in its first position, and to adopt a retracted position relative to the foot or to the lower leg when in its second position. This pressing element may notably be positioned toward the top, at the back of the cuff 3 of the ski boot. When the pressing element is in its first position, it contributes to firmly holding the lower leg, allowing precise guidance of the gliding board fixed to the ski boot. When the pressing element is in its second position, it adopts a position away from the lower leg, allowing the ankle of the user a certain mobility within the ski boot, thus making walking easier. The pressing element also constitutes an accessory of the ski boot which accessory is intended to make walking easier when in its retracted position.

As detailed hereinafter, the operating device 5 is configured to actuate the tightening means 6 and also an accessory of the ski boot, for example the locking device 10.

FIGS. 2 to 5 illustrate a first embodiment of the operating device 5. The operating device 5 comprises a baseplate 11 fixed to the wall 7 of the cuff 3, for example using rivets or screws. For this purpose, the baseplate 11 is equipped with fixing holes 12, clearly visible in FIG. 3. The baseplate may comprise a face 13 pressing against the wall 7 and that has a shape that is curved to conform to the shape of the cuff 3.

The operating device 5 also comprises a first lever 14 and a second lever 15 distinct from the first lever. Each of the two levers 14 and 15 is able to move reversibly between a first position and a second position. According to the embodiment depicted, the first position is a closed position, as depicted in FIGS. 1 to 6, and the second position is an open position. As a preference, the open position of the levers 14 and 15 is obtained by pivoting the levers about an axis of rotation Z1, for example by rotating the levers 14 and 15 about the axis of rotation Z1 by the order of 180°. In other words, the open and closed positions of the levers 14 and 15 are distinguished from one another by a rotation of said levers through the order of 180°. According to an alternative form of embodiment of the invention, said first position could correspond to the open position of the levers and said second position could correspond to the closed position of the levers.

The first lever 14 is configured to actuate the tightening means 6. Therefore the first lever is connected to the tightening means 6. In particular, the first lever 14 is connected to the tightening means 6 in such a way that the tightening means 6 is in a tightened configuration when the first lever 14 is in the closed position and so that the tightening means 6 is in the released configuration when the first lever 14 is in the open position. The second lever 15 is configured to actuate at least one accessory of the shoe/boot, notably the locking device 10. Therefore the second lever is connected to said accessory of the shoe/boot. In particular, the second lever 15 is connected to the locking device 10 such that the locking device 10 is in the ski configuration when the second lever 15 is in the closed position and such that the locking device 10 is in the walk configuration when the second lever 15 is in the open position. The second lever 15 is configured to actuate an accessory independent of the tightening means 6.

The levers 14 and 15 are members of the operating device 5 that are intended to be manipulated by hand. Thus they each comprise at least one manipulation surface configured to allow a user to move them between their open position and their closed position. The first lever 14 and the second lever 15 are configured to rest one upon the other such that when the first lever 14 is in the closed position, the second lever 15 is automatically in the closed position. Likewise, when the second lever 15 is in the open position, the first lever 14 is automatically in the open position. In other words, the closing of the first lever 14 automatically leads to the closing of the second lever 15, and the opening of the second lever 15 automatically leads to the opening of the first lever 14. Therefore, when the tightening device 6 is in the tightened configuration, the locking device 10 is automatically in the ski configuration. This makes it possible to avoid the user skiing with the articulation between the lower shell and the cuff unlocked, something which would lead to imprecise guidance of the gliding board. Likewise, this also allows the tightening means 6 to be loosened automatically when the locking device is moved into the walk configuration.

As an alternative or in addition, the second lever 15 could be configured to actuate any other accessory of the shoe/boot, notably a mobile pressing element, or even one or more additional tightening devices 9. If the second lever 15 is configured to actuate a pressing element as described hereinabove, then the second lever is connected to this element such that when the second lever is in the closed position, the pressing element is in the position of pressing against the foot or the lower leg of the user, and when the second lever is in the open position, the pressing element is in its retracted position. If the second lever 15 is configured to actuate an additional tightening device 9, then the second lever is connected to this additional tightening device such that when the second lever is in the closed position, the additional tightening device is in a configuration tightly holding the foot or the lower leg of the user and when the second lever is in the open position, the additional tightening device is in a configuration of releasing the foot or the lower leg of the user.

The first lever 14 comprises a first manipulation surface 16 configured to allow a user to move it from its open position to its closed position, and a second manipulation surface 17 configured to allow the user to move it from its closed position to its open position. In this particular instance, the first manipulation surface 16 and the second manipulation surface 17 are arranged on two opposite faces of the first lever 14. When the first lever 14 is in the closed position, the first manipulation surface 16 faces towards the outside of the shoe/boot and the second manipulation surface 17 faces towards the wall 7 of the cuff. The first manipulation surface 16 is configured to be pushed by the user against the wall 7 of the cuff, which is to say towards the foot or the lower leg of the user. The second manipulation surface 17 is configured to move it away from the wall 7 of the cuff, which is to say be pulled by the user towards the outside of the foot or of the lower leg of the user.

Likewise, the second lever 15 comprises a first manipulation surface 18 configured to allow the user to move it from its open position to its closed position, and a second manipulation surface 19 configured to allow the user to move it from its closed position to its open position. The first manipulation surface 18 and the second manipulation surface 19 are arranged on two opposite faces of the second lever 15. When the second lever is in the closed position, the first manipulation surface 18 faces towards the outside of the shoe/boot and the second manipulation surface 19 faces towards the wall 7. The first manipulation surface 18 of the second lever 15 is configured to be pushed by the user against the wall 7 of the cuff, which is to say towards the foot or the lower leg of the user. The second manipulation surface 19 of the second lever 15 is configured to move it away from the wall 7 of the cuff, which is to say to be pulled by the user towards the outside of the foot or of the lower leg of the user. The second manipulation surfaces 17 and 19 of each lever 14, 15 extend in planes that are inclined with respect to the wall 7 on which the operating device is fixed. Thus, these second manipulation surfaces 17 and 19 are positioned spaced away from said wall 7 when the second lever is in the closed position, making them easier to clasp. Specifically, the user can more easily insert their fingertips between the second manipulation surfaces 17 and 19 and the wall 7, even when wearing gloves.

Figure 2:
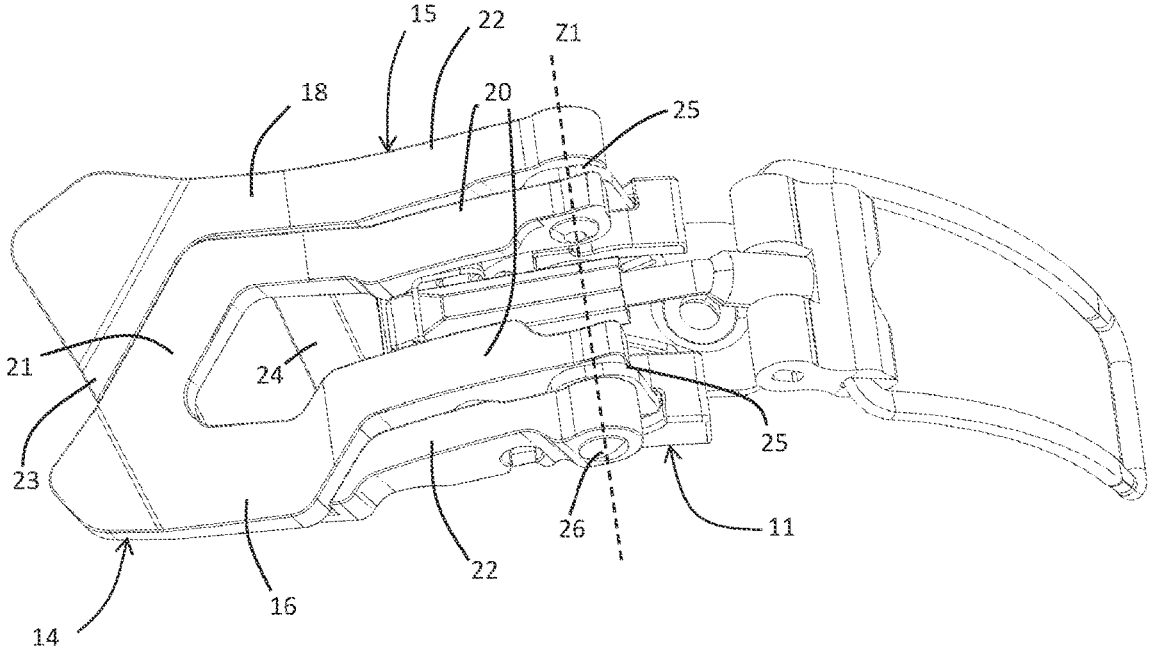
FIG. 2 is a perspective view, from the outside of the ski boot, of the operating device of FIG. 1.

As is clearly visible in FIG. 2, the first lever 14 and the second lever 15 are superposed when the first lever and the second lever are in the closed position. More specifically, the first lever 14 partially covers the second lever 15. In other words, the second lever 15 comprises a first part covered by the first lever 14 and a second part not covered by the first lever. Thus, the second lever 15 remains clearly visible and readily accessible when the levers 14, 15 are in the closed position. The second manipulation surface 19 of the second lever is formed in the second part of the lever 15, which is to say in that part of the second lever 15 that is not covered by the first lever. Moreover, the first lever 14 also comprises a first part which covers the second lever 15 and a suspended second part which extends beyond the second lever. Advantageously, the second manipulation surface 17 of the first lever is formed in the second part of the first lever 14, making it possible to maintain an even greater empty volume between the second manipulation surface 17 and the wall 7 on which the operating device is fixed. This makes the first lever easier to manipulate. Note that according to one embodiment variant, the first lever 14 could extend only over the second lever 15, the inclination of the manipulation surface 17 relative to the second lever 15 then allowing the first lever 14 to be gripped independently of the second lever 15. When they are in the closed position, the first lever rests directly on the second lever, without contacting the wall 7 and the second lever rests directly on the wall 7.

When the two levers 14, 15 are in the open position and the first lever is manipulated in the direction for closing, the first lever presses on the second lever (notably the first part of the first lever presses on the first part of the second lever). The force applied to the first lever in order to close it is thus transmitted to the second lever, allowing both levers to move simultaneously into the closed position. Likewise, when the two levers 14, 15 are in the closed position and the second lever is manipulated in the direction of opening, the second lever presses on the first lever (notably the first part of the second lever presses on the first part of the first lever). The force applied to the second lever is thus transmitted to the first lever allowing both levers to pass simultaneously into the open position. In addition, the operating device 5 is also configured such that the first lever 14 can be actuated independently of the second lever 15 when the latter is in the closed position. Likewise, the operating device 5 is also configured so that the second lever 15 can be actuated independently of the first lever 14 when the latter is in the open position. The operating device thus comprises three configurations of operation:

- a first configuration corresponding to the closed position of the first lever and of the second lever,
- a second configuration corresponding to the open position of the first lever and to the closed position of the second lever, and
- a third configuration corresponding to the open position of the first lever and of the second lever.

At any moment, the user can pass directly from one configuration to another. In particular, it is possible through a single action for the user to pass from the first configuration to the second configuration, or from the second configuration to the first configuration, without passing through the first configuration.

The first lever 14 and the second lever 15 are both able to rotate relative to the baseplate 11 about the one same first axis of rotation Z1. This first axis of rotation Z1 may be oriented at least roughly vertically when the operating device is fixed to a ski boot resting on the horizontal ground.

The first lever 14 comprises the form of a bow, or in other words is U-shaped. It comprises two branches 20 together connected to a common base 21. As an alternative, the first lever could adopt a different shape, notably a shape that is rectangular overall and/or that does not have an opening. The bow shape of the first lever nevertheless makes it lighter in weight. The first axis of rotation Z1 is positioned substantially at one end of each branch 20, the opposite end from the base 21. The first manipulation surface 16 may be formed on external faces of the branches 20 and/or of the base 21. The second manipulation surface 17 of the first lever 14 may be formed on an internal face of the base 21 and/or of the branches 20, more specifically at a corner of the first lever where a branch 20 meets the base 21. The second manipulation surface 17 is advantageously positioned at the opposite end of the first lever 14 from the first axis of rotation Z1, so as to offer the user a long lever arm for the operation of opening of the first lever 14.

Likewise, the second lever 15 (clearly visible in FIG. 4) may also have a bow shape. In particular, the second lever comprises two branches 22 connected to one another at a common base 23. The second lever further comprises a transverse element 24 extending between the two branches 22, approximately midway along the length of these. As an alternative, the second lever could adopt a different shape, notably a shape that is rectangular overall and/or that does not have an opening. Nevertheless, the bow shape of the second lever allows it to be lighter in weight. The first axis of rotation Z1 is arranged substantially at one end of each branch 22, the opposite end to the base 23. The first manipulation surface 18 may be formed on external faces of the branches 22 and/or of the base 23 and/or of the transverse element 24. The second manipulation surface 19 of the second lever 15 may be formed on an internal face of the base 23 and/or of the branches 22, more specifically at a corner of the second lever where a branch 22 meets the base 23. As before, the second manipulation surface 19 is advantageously positioned at the opposite end of the second lever 15 from the first axis of rotation Z1, so as to offer the user a long lever arm for the operation of opening the second lever 15. The manipulation surfaces 17 and 19 are distant from one another. For example, the manipulation surface 17 may be arranged toward the bottom of the ski boot while the manipulation face 19 may be arranged towards the top of the boot. As an alternative, these positions could be reversed. The separation between the manipulation surfaces 17 and 19 allows the user to operate them blind.

The first lever 14 extends at least in part between the two branches 22 of the second lever 15. In particular, the two branches 20 of the first lever extend parallel to the branches 22 of the second lever but are not as far apart from one another as the two branches 22 of the second lever 15. The baseplate 11 comprises two bearings 25 through each of which there passes a shaft 26. Each shaft 26 collaborates both with an opening at the end of one branch 20 of the first lever and with an opening at the end of one branch 22 of the second lever. Each bearing 25 extends into a gap formed between one branch 20 of the first lever and one branch 22 of the second lever.

The pressing surface via which the first lever presses against the second lever may extend over an internal face of part of the branches 20 and/or of the base 21. The pressing surface via which the second lever presses against the first lever may extend over an external face of part of the branches 22, of the base 23 and/or of the transverse element 24. Advantageously, the second lever 15 comprises a housing 27, or in other words a recess, inside which the first lever 14 is positioned when it is in the closed position. The housing 27 may be obtained by a locally reduced thickness of the second lever. The presence of this housing 27 allows the first lever to maintain the correct position relative to the second lever and allows optimal transmission of pressure between the two levers as they are manipulated. Further, it makes it possible to keep the operating device more compact. Alternatively, the housing or recess 27 could be formed in the first lever. In a variant form of embodiment of the invention, a small amount of interference could be established between the first lever and the second lever when they are pressing against one another. Thus, the two levers may remain secure to one another when nested one inside the other. Light pressure on the part of the user may then suffice to disconnect the two levers so that they can be manipulated separately.

The first lever 14 and the second lever 15 may advantageously be single-piece components. As a preference, they may also be machined metal components. Alternatively, they may be made of plastic, possibly with an internal metal insert to improve strength and stiffness. The levers 14, 15 may be manufactured for example by machining, by moulding or else by an additive manufacturing method.

Figure 5:
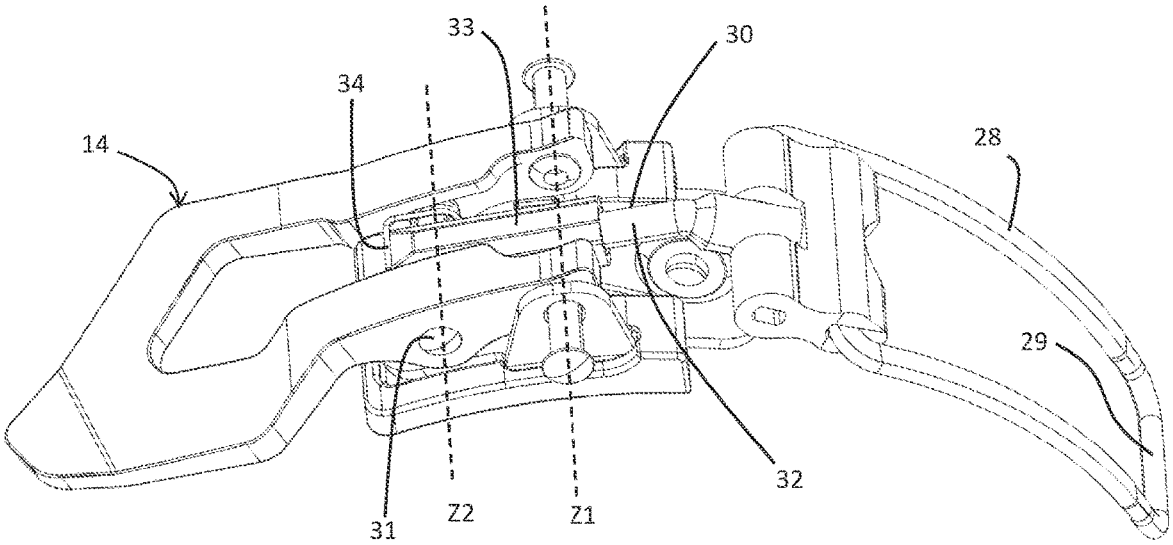
FIG. 5 is a perspective view of the operating device of FIG. 1, in which a second lever of the operating device is hidden from view.

With reference to FIG. 5, the tightening means 6 comprises a tightening buckle 28 fixed to the first lever 14 about a second axis of rotation Z2 distinct from the first axis of rotation Z1. The tightening buckle 28 may be made for example of rigid or flexible metal wire. It comprises a first end 29 intended to collaborate with the set of ratchet teeth 8. In addition, the tightening means 6 comprises a connecting means 30, or tie rod 30, by means of which the tightening buckle 28 is connected to a shaft 31 extending along the axis of rotation Z2. The shaft 31 extends between the two branches 20 of the first lever 14. The connecting means 30 extends between the two branches 20 of the first lever 14. The connecting means 30 may notably comprise a means of adjusting the distance separating the end 29 from the axis of rotation Z2. This adjusting means may notably be formed by means of a threaded rod 32 secured to the tightening buckle 28 and collaborating with an elongate element 33 in which a tapped opening is formed. The elongate element 33 also comprises an opening through which the shaft 31 passes. The distance separating the end 29 from the axis of rotation Z2 is adjusted by turning the threaded rod 32 through one or more turns relative to the elongate element 33. Further, the tightening means 6 may also comprise a return means, notably in the form of a torsion spring 34, arranged between the elongate element 33 and the first lever 14. This return means may be arranged such that the tightening buckle 28 adopts a preferred orientation when the first lever 14 is in the open position, so as to make it easier to bring the end 29 closer to the set of ratchet teeth 8. Advantageously, the tightening means 6 may be configured so that the tightening buckle 28 remains in mesh with the set of ratchet teeth 8 even when the first lever 14 is in the open position. Thus, the tightness setting of the shoe/boot remains unchanged when the first lever moves into the open position.

Figure 3:
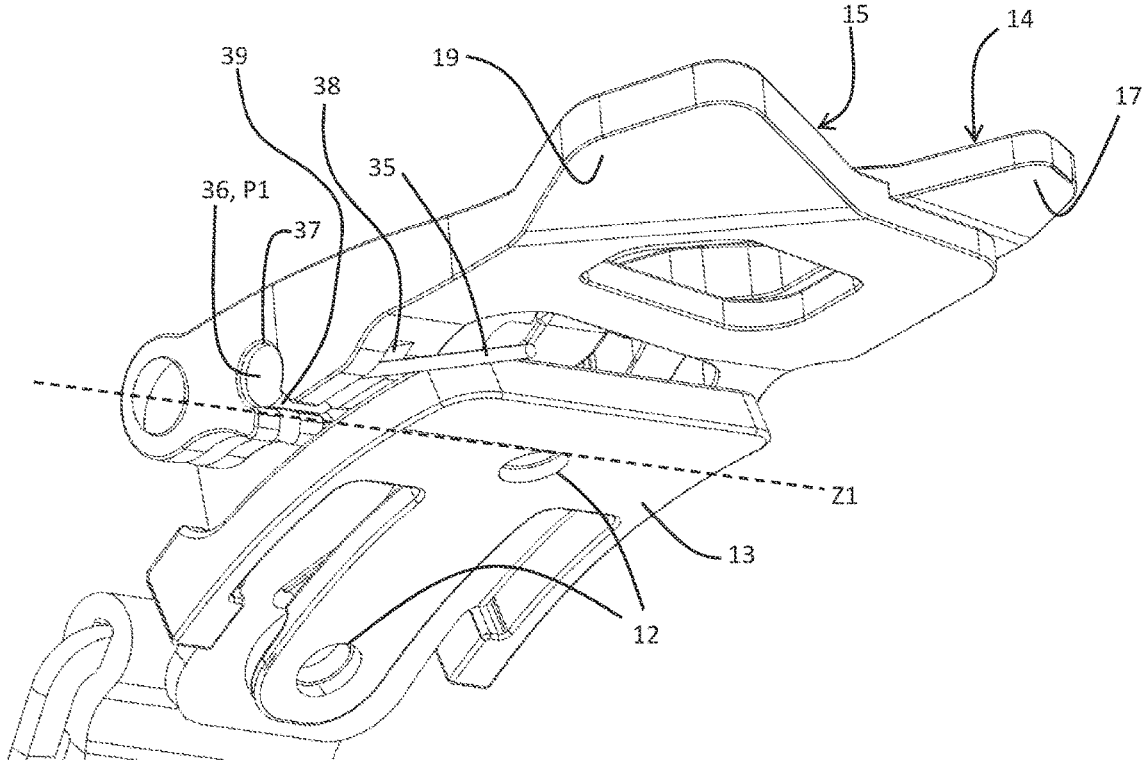
FIG. 3 is a perspective view, from the inside of the ski boot, of the operating device of FIG. 1.
Figure 4:
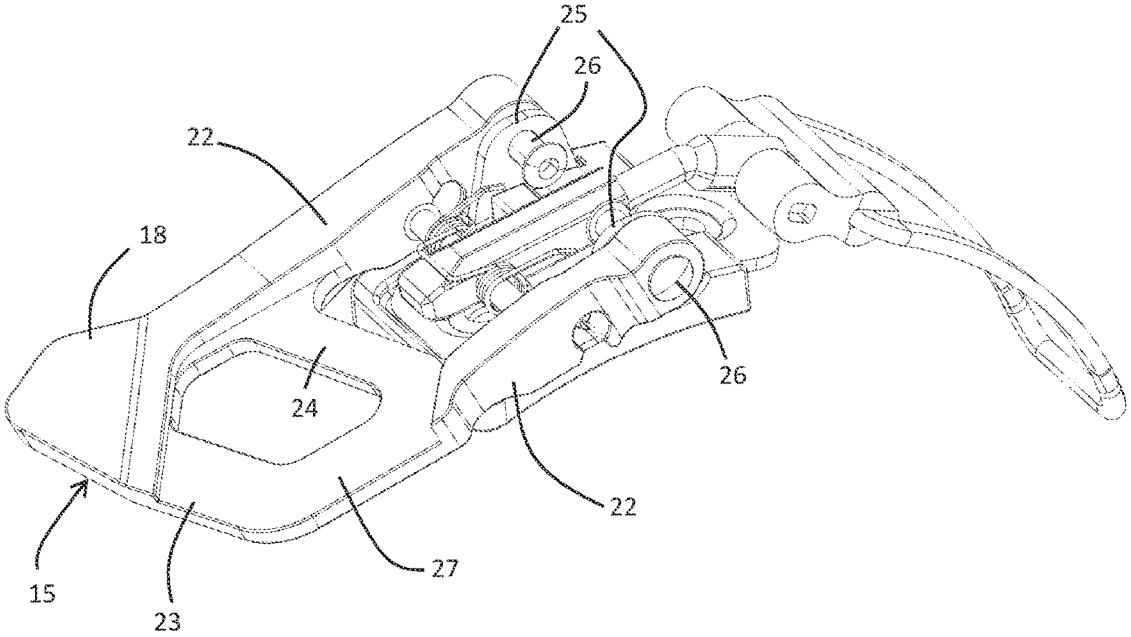
FIG. 4 is a perspective view of the operating device of FIG. 1, in which a first lever of the operating device is hidden from view.

As is clearly visible in FIG. 3, the operating device 5 also comprises a wire 35 intended to actuate an accessory of the ski boot, notably the locking device 10. This wire 35, which is also depicted schematically in FIG. 1 in the form of a dotted line, may potentially be arranged inside a sheath. The wire 35 may for example be a steel cable or a wire made of synthetic material such as nylon for example. The wire 35 may be arranged on the outside of the lower shell 2 and/or of the cuff 3. Alternatively, it may pass through a hole made in the lower shell or the cuff. The wire 35 constitutes a means for transmitting force applied to the second lever 15 to the accessory to which it is connected. As an alternative or in addition, other transmission means such as springs, gears or even hydraulic piping may be envisaged. These other transmission means may be used as a replacement for the wire 35 or in combination with the wire 35, for example at the interface between the wire 35 and the second lever 15. The wire 35 has a first end 36 fixed to the second lever 15 at a point P1 distinct from the first axis of articulation Z1 and a second end fixed to said accessory. The first end 36 may be provided with a cylindrical element engaged in a housing 37 provided in one of the branches 22 of the second lever 15. According to the embodiment depicted, a single wire 35 is connected to the second lever 15. As an alternative, two or even a greater number of wires may be connected to the second lever so as to control two accessories or a greater number of accessories of the shoe/boot. Further, the one same wire may be configured to control several distinct accessories, for example by having a wire branch. Moreover, the second lever 15 may potentially comprise several housings 37, notably one housing 37 on each of its branches 22 so as to offer various options as to how to secure the first end 36 of the wire. The housing 37 may be extended by a groove 38 in which a portion of the wire extends. This groove 38 makes it possible to avoid interference between the second lever 15 and the wire 35. The groove 38 also protects the wire from external attack. The housing 37 may also comprise an opening 39 on the internal face of the second lever 39. This opening 39 provides a passage for the wire 35 during operations of assembling or dismantling the operating device.

When the second lever 15 is in the closed position, the wire 35 may project overall in the direction in which the second lever extends from the axis of rotation Z1, which is to say in the opposite direction to the direction in which the tightening device extends. The direction in which the wire extends may be dictated by the position of the accessory controlled by the wire and/or by the position of a means for guiding the wire, such as a sheath or a pulley. Thus, according to the embodiment depicted, rotation of the second lever from its closed position to its open position causes the wire 35 to become tensioned. In a variant embodiment, the wire 35 could project from the second lever in a different direction so that it is the rotation of the second lever from its open position to its closed position that causes the wire 35 to become tensioned.

In order to use the operating device that has just been described, a user may proceed as follows. Having inserted their foot into the shoe/boot they may allow the first lever and the second lever to move into the open position. Thus, the lower leg is held only loosely if at all and the locking device 10 does not block the rotation articulation between the lower shell and the cuff. Thus, the user can comfortably walk around and/or wait. When the user is ready to ski, they may close the first lever 14 by pressing on the zone 16 intended for grasping. The first lever pivots about the axis of rotation Z1. The rotation of the first lever tends to move the second axis of rotation Z2, causing the tightening buckle 28 to tighten onto the set of ratchet teeth 8. At the same time, the first lever 14 presses against the second lever 15 which likewise pivots about the axis of rotation Z1 and moves automatically into the closed position. The rotation of the second lever 15 causes the anchor point of the wire 35 to move, reducing the tension in the wire, allowing the accessory to which it is connected to be activated. Advantageously, the accessory may comprise an internal return means so that it switches configuration when the tension in the wire 35 decreases. Thus, in a single action, the user is able to actuate the tightening device 6 and the accessory connected to the second lever. In particular, in instances in which said accessory corresponds to said locking device 10, the user automatically achieves locking of the rotation articulation between the lower shell and the cuff, allowing precise guidance of the skis. This then prevents the user from skiing with a rotation articulation between the lower shell and the cuff unlocked. Thus, tightening of the tightening device 6 necessary involves activating the locking mechanism that locks the cuff to the lower shell. The force required to cause the first lever and the second lever to pivot from their open position to their closed position increases first of all, then reaches a maximum value during the course of the travel, and then starts to decrease again. Thus, the open position and the closed position of the levers 14, 15 are stable positions.

Next, during a subsequent phase of resting, the user may pull on the second surface 19 intended for clasping so as to open the second lever. In doing so, the wire 35 becomes tensioned and actuates the accessory into a new configuration. The opening of the second lever automatically leads to the opening of the first lever. Once again, a single action on the part of the user is enough to slacken the tightening device and actuate the accessory simultaneously or near-simultaneously. If the user so desires, they may also use the ski boot in an intermediate configuration in which the first lever is in the open position and the second lever is in the closed position. For that, from the position in which the first lever and the second lever are closed, the user may simply pull on the surface 17 intended for clasping. Alternatively, starting from the position in which the two levers 14 and 15 are open, the user may simply push on the surface 18 of the second lever that is intended for clasping. The operating device thus allows the shoe/boot to be used in three distinct configurations. Assuming that said accessory is a locking device 10, the user may use the shoe/boot with blocking of the rotation articulation between the lower shell and the cuff, and with the tightening device 6 slackened. This allows skiing, which while admittedly less precise is nevertheless more comfortable. Such a configuration is also particularly useful when the user is using a lift such as a chairlift or a ski lift. Specifically, on the one hand, the slackening of the cuff provides the user with some relief when using the lift. On the other hand, the blocking of the rotation articulation makes it possible to maintain enough guidance of the gliding board to keep the use of the lift safe. In particular, the blocking of the rotation articulation allows the user sufficient guidance of the gliding board during the phase of leaving the chairlift during which phase the user leaves the chairlift and/or while the user is being pulled along by a ski lift bar.

According to an alternative form of embodiment, the functions of the first lever and of the second lever could be reversed, which is to say that it is the first lever that would then control said accessory and the second lever that would control the tightening device.

Figure 6:
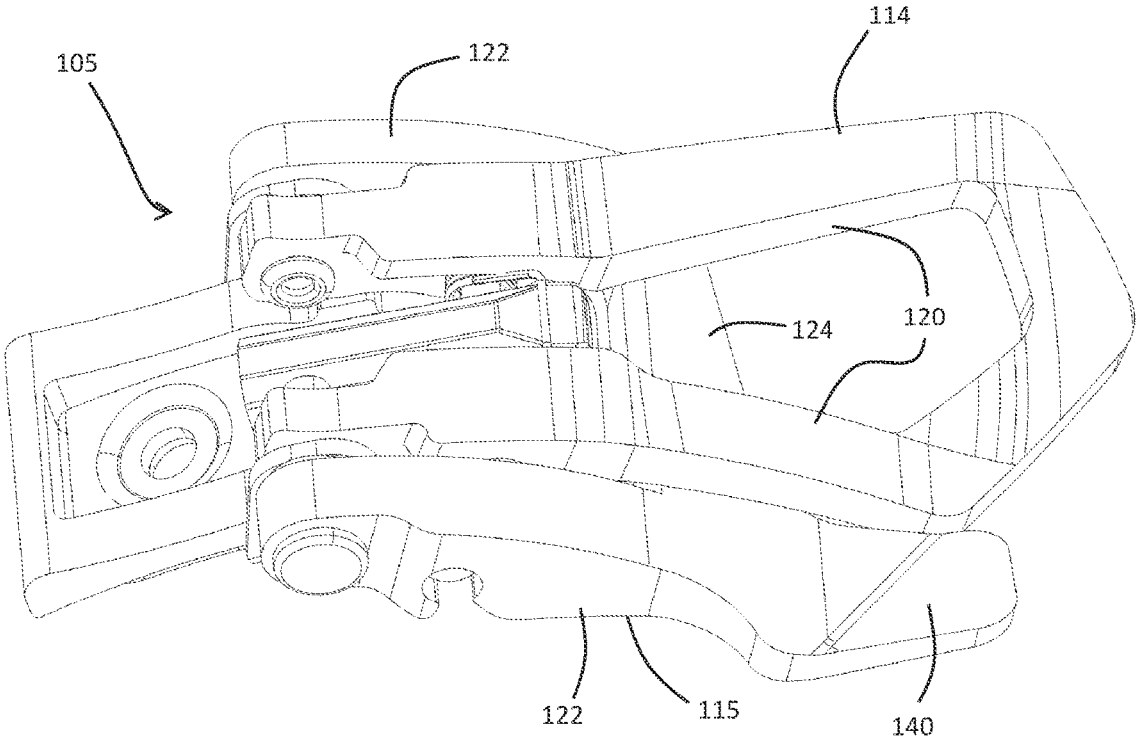
FIG. 6 is a perspective view, from the outside of the ski boot, of an operating device according to a second embodiment of the invention, with a first lever and a second lever of the operating device in the closed position.
Figure 7:
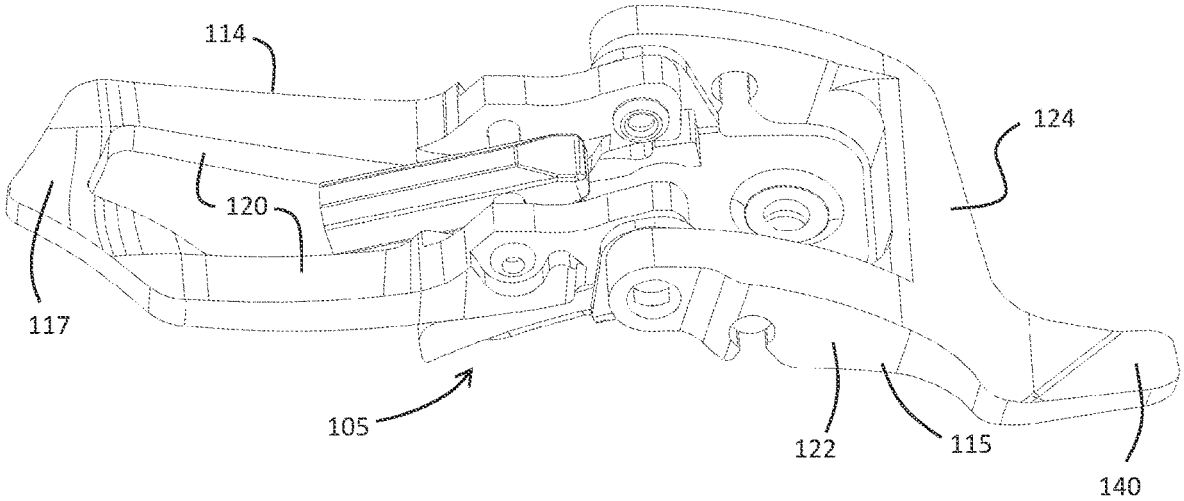
FIG. 7 is a view of the operating device of FIG. 6, the first lever being in the open position and the second lever being in the closed position.
Figure 8:
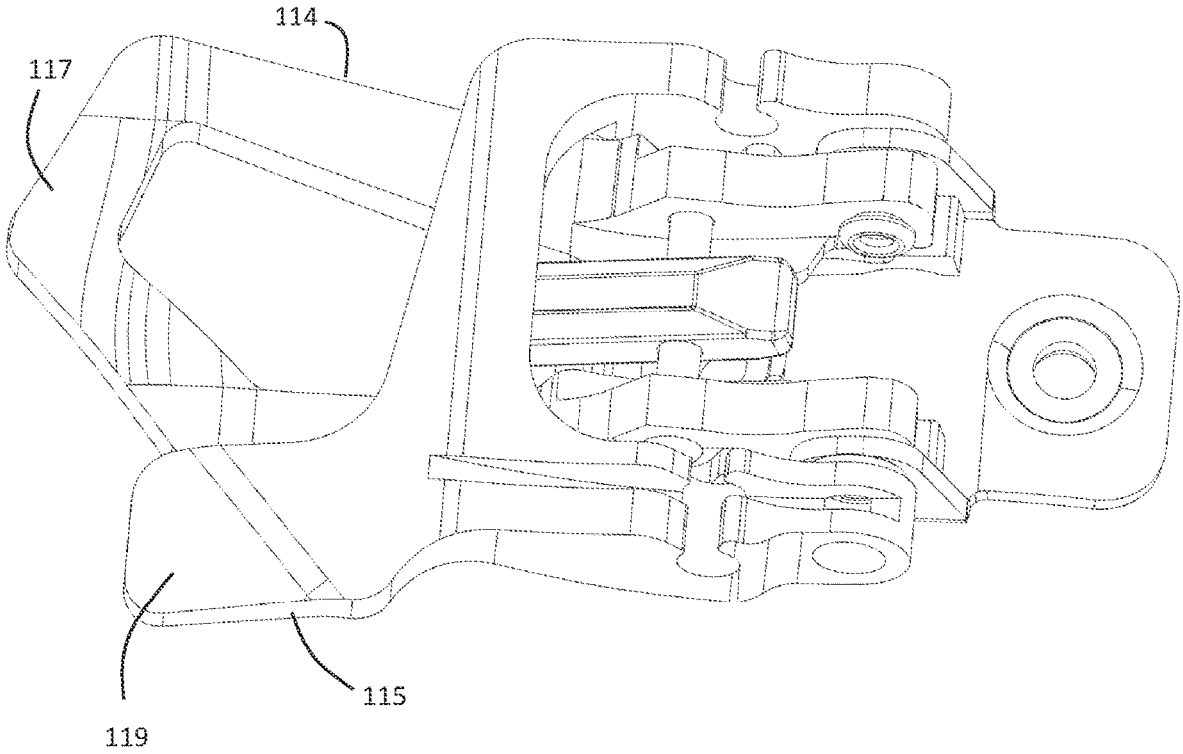
FIG. 8 is a view of the operating device of FIG. 6, with the first lever and the second lever in the open position.

FIG. 6 illustrates an operating device 105 according to an alternative form of embodiment of the invention. This alternative form of embodiment differs from the first embodiment described above essentially in terms of the shape of the first lever 114 and of the second lever 115. In particular, the second lever 115 is substantially h-shaped. It comprises two branches 122 connected by a transverse element 124. One of the two branches 122 is not covered by the first lever 114. This branch 122 comprises a projection 140 extending to the side of the first lever 114. A second manipulation surface 119 of the second lever 115, which surface is configured to move the second lever from a closed position to an open position, is formed on an internal face of the protrusion 140. The transverse element 124 collaborates with the branches 120 of the first lever to transmit the forces of opening or of closing from one lever to the other. According to this embodiment, the first lever rests directly against the wall of the ski boot when the first lever is in the closed position. FIG. 7 illustrates the operating device 105 in a configuration in which the first lever 114 is in the open position and the second lever 115 is in the closed position. FIG. 8 illustrates the operating device 105 in a configuration in which the first lever 114 and the second lever 115 are in the open position. The first lever 114 and the second lever 115 are superposed, and the second lever covers the first lever 114. The open position of the levers 14 and 15 of the operating device 5 according to the first embodiment of the invention may be analogous to the open position of the levers 114 and 115 that may be seen in FIG. 7 or 8.

The invention thus provides a ski boot that is practical and easy to use. Its user can easily adapt the compromise between comfort and use performance. Finally, this invention set out in the context of a ski boot could be reapplied to a sports shoe/boot of different construction, notably a sports shoe/boot that is not necessarily a ski boot and/or that does not necessarily comprise a lower shell and a cuff articulated in rotation about the lower shell.

The invention claimed is:

1. A sports shoe or boot, comprising:

a lower shell intended to envelop a foot of a user, a cuff intended to envelop a lower leg of the user, a rotation articulation between the lower shell and the cuff, an operating device, the operating device comprising:

tightening means configured to tighten the cuff around the lower leg of the user and/or to tighten the lower shell around the foot of the user, a first lever configured to move between a first position and a second position of the first lever, the first lever being configured to actuate the tightening means, the first lever comprising at least one manipulation surface configured to allow a user to move the first lever from the first position of the first lever to the second position of the first lever, wherein the first lever is connected to the tightening means so that:

when the first lever is in the first position of the first lever, the cuff is in a tightened state around the lower leg of the user and/or the lower shell is in a tightened state around the foot of the user, and when the first lever is in the second position of the first lever, the cuff is not in the tightened state around the lower leg of the user and/or the lower shell is not in the tightened state around the foot of the user, a locking device configured to lock the rotation articulation between the lower shell and the cuff, a second lever, distinct from the first lever, the second lever being configured to move between a first position and a second position of the second lever, the second lever being configured to actuate the locking device independently from the tightening means, the second lever comprising at least one manipulation surface configured to allow the user to move the second lever from the first position of the second lever to the second position of the second lever, wherein the second lever is connected to the locking device so that:

when the second lever is in the first position of the second lever, the rotation articulation between the lower shell and the cuff is locked, and when the second lever is in the second position of the second lever, the rotation articulation between the lower shell and the cuff is released, wherein the first lever and the second lever are configured to rest one upon the other, wherein at least one of:

(i) the first lever is configured to rest upon the second lever, so that when the first lever is in the first position of the first lever, the second lever is automatically in the first position of the second lever, and when the second lever is in the second position of the second lever, the first lever is automatically in the second position of the first lever, wherein the second lever is configured to actuate the locking device independently from the tightening means when the first lever is in the second position of the first lever, or (ii) the second lever is configured to rest upon the first lever, so that when the second lever is in the first position of the second lever, the first lever is automatically in the first position of the first lever, and when the first lever is in the second position of the first lever, the second lever is automatically in the second position of the second lever, wherein the second lever is configured to actuate the locking device independently from the tightening means when the first lever is in the first position of the first lever.

2. The sports shoe or boot according to claim 1, wherein the first lever partially covers the second lever when the first lever is in the first position of the first lever and the second lever is in the first position of the second lever.

3. The sports shoe or boot according to claim 1, wherein the tightening means is in a configuration of tightly holding the foot or the lower leg of the user when the first lever is in the first position of the first lever, and in a configuration of releasing the foot or the lower leg of the user when the first lever is in the second position of the first lever.

4. The sports shoe or boot according to claim 1, wherein the first lever and the second lever are able to rotate about a same axis of rotation.

5. The sports shoe or boot according to claim 1, wherein the second lever comprises a bow provided with two branches extending parallel to one another and the first lever extends at least partly between the two branches of the second lever.

6. The sports shoe or boot according to claim 5, wherein the first lever comprises a bow provided with two branches extending parallel to one another, the two branches of the first lever being arranged between the two branches of the second lever, the tightening means comprising a tightening buckle able to engage with a catch and connecting means fixed to the first lever and to the tightening buckle, the connecting means extending between the two branches of the first lever.

7. The sports shoe or boot according to claim 1, wherein the second lever comprises a housing inside which the first lever is positioned when the first lever is in the first position of the first lever, and/or wherein the first lever comprises a housing inside which the second lever is positioned when the first lever is in the first position of the first lever.

8. The sports shoe or boot according to claim 1, wherein the first lever is able to rotate about a first axis of rotation and the tightening means comprises a tightening buckle fixed to the first lever about a second axis of rotation distinct from the first axis of rotation.

9. The sports shoe or boot according to claim 1, wherein the second lever is able to rotate about a first axis of rotation and the operating device comprises a wire intended to actuate the locking device, the wire being fixed to the second lever at a point distinct from the axis of rotation.

10. The sports shoe or boot according to claim 1, which has three configurations of operation:

a first configuration corresponding to the first position of the first lever and the first position of the second lever, a second configuration corresponding to the second position of the first lever and the first position of the second lever, and a third configuration corresponding to the second position of the first lever and the second position of the second lever.

11. The sports shoe or boot according to claim 1, wherein the first lever comprises a first manipulation surface configured to allow a user to move the first lever from the second position of the first lever to the first position of the first lever, and a second manipulation surface configured to allow the user to move the first lever from the first position of the first lever to the second position of the first lever.

12. The sports shoe or boot according to claim 1, wherein the second lever comprises a first manipulation surface configured to allow the user to move the second lever from the second position of the second lever to the first position of the second lever, and a second manipulation surface configured to allow the user to move the second lever from the first position of the second lever to the second position of the second lever.

13. The sports shoe or boot according to claim 1, which further comprises a pressing element able to move between a first position and a second position, the pressing element being intended to apply pressure to the foot or the lower leg of the user when the pressing element is in the first position of the pressing element, the pressing element being intended to adopt a retracted position relative to the foot or to the lower leg of the user when the pressing element is in the second position of the pressing element, the second lever being connected to the pressing element so that:

when the second lever is in the first position of the second lever, the pressing element is in the first position of the pressing element, and when the second lever is in the second position of the second lever, the pressing element is in the second position of the pressing element.

14. The sports shoe or boot according to claim 1, wherein the operating device is fixed to a wall of the sports shoe or boot, and wherein the first lever extends against the wall or against the second lever when the first lever is in the first position of the first lever, the first lever comprising a manipulation surface configured to allow the user to move the first lever from the first position of the first lever to the second position of the first lever, the manipulation surface of the first lever being positioned so that the first lever is spaced away from the wall or from the second lever when the first lever is in the first position of the first lever.

15. The sports shoe or boot according to claim 1, wherein the second lever extends against a wall of the sports shoe or boot or against the first lever when the second lever is in the first position of the second lever, the second lever comprising a manipulation surface that is configured to allow the user to move the second lever from the first position of the second lever to the second position of the second lever, the manipulation surface of the second lever being positioned so that the second lever is spaced away from the wall or from the first lever when the second lever is in the first position of the second lever.

16. The sports shoe or boot according to claim 1, which is a ski boot.

17. The sports shoe or boot according to claim 2, wherein the tightening means is in a configuration of tightly holding the foot or the lower leg of the user when the first lever is in the first position of the first lever, and in a configuration of releasing the foot or the lower leg of the user when the first lever is in the second position of the first lever.

18. The sports shoe or boot according to claim 2, wherein the first lever and the second lever are able to rotate about a same axis of rotation.

19. The sports shoe or boot according to claim 1, wherein the first lever is configured to rest upon the second lever, so that when the first lever is in the first position of the first lever, the second lever is automatically in the first position of the second lever, and when the second lever is in the second position of the second lever, the first lever is automatically in the second position of the first lever, wherein the second lever is configured to actuate the locking device independently from the tightening means when the first lever is in the second position of the first lever.

20. The sports shoe or boot according to claim 1, wherein the second lever is configured to rest upon the first lever, so that when the second lever is in the first position of the second lever, the first lever is automatically in the first position of the first lever, and when the first lever is in the second position of the first lever, the second lever is automatically in the second position of the second lever, wherein the second lever is configured to actuate the locking device independently from the tightening means when the first lever is in the first position of the first lever.

21. A sports shoe or boot, comprising:

a lower shell intended to envelop a foot of a user, a cuff intended to envelop a lower leg of the user, a rotation articulation between the lower shell and the cuff, and an operating device, the operating device comprising:

tightening means configured to tighten the cuff around the lower leg of the user and/or to tighten the lower shell around the foot of the user, a first lever configured to move between a first position and a second position of the first lever, the first lever being configured to actuate the tightening means, the first lever comprising at least one manipulation surface configured to allow a user to move the first lever from the first position of the first lever to the second position of the first lever, wherein the first lever is connected to the tightening means so that:

when the first lever is in the first position of the first lever, the cuff is in a tightened state around the lower leg of the user and/or the lower shell is in a tightened state around the foot of the user, and when the first lever is in the second position of the first lever, the cuff is not in the tightened state around the lower leg of the user and/or the lower shell is not in the tightened state around the foot of the user, a pressing element configured to move between a first position and a second position, a second lever, distinct from the first lever, the second lever being configured to move between a first position and a second position of the second lever, the second lever being configured to actuate the pressing element independently from the tightening means, the second lever comprising at least one manipulation surface configured to allow the user to move the second lever from the first position of the second lever to the second position of the second lever, wherein the second lever is connected to the pressing element so that:

when the second lever is in the first position of the second lever, the pressing element presses against the foot or the lower leg of the user, and when the second lever is in the second position of the second lever, the pressing element adopts a retracted position relative to the foot or the lower leg of the user, wherein the first lever and the second lever are configured to rest one upon the other, wherein at least one of:

(i) the first lever is configured to rest upon the second lever, so that when the first lever is in the first position of the first lever, the second lever is automatically in the first position of the second lever, and when the second lever is in the second position of the second lever, the first lever is automatically in the second position of the first lever, wherein the second lever is configured to actuate the pressing element independently from the tightening means when the first lever is in the second position of the first lever, or (ii) the second lever is configured to rest upon the first lever, so that when the second lever is in the first position of the second lever, the first lever is automatically in the first position of the first lever, and when the first lever is in the second position of the first lever, the second lever is automatically in the second position of the second lever, wherein the second lever is configured to actuate the pressing element independently from the tightening means when the first lever is in the first position of the first lever.

22. The sports shoe or boot according to claim 21, wherein the first lever is configured to rest upon the second lever, so that when the first lever is in the first position of the first lever, the second lever is automatically in the first position of the second lever, and when the second lever is in the second position of the second lever, the first lever is automatically in the second position of the first lever, wherein the second lever is configured to actuate the pressing element independently from the tightening means when the first lever is in the second position of the first lever.

23. The sports shoe or boot according to claim 21, wherein the second lever is configured to rest upon the first lever, so that when the second lever is in the first position of the second lever, the first lever is automatically in the first position of the first lever, and when the first lever is in the second position of the first lever, the second lever is automatically in the second position of the second lever, wherein the second lever is configured to actuate the pressing element independently from the tightening means when the first lever is in the first position of the first lever.

24. An operating device for a sports shoe or boot, the operating device comprising:

tightening means intended to tighten the sports shoe or boot around a foot or lower leg of a user, at least one accessory of the sports shoe or boot, the accessory being distinct from the first lever and from the tightening means, the accessory being configured to make it easier for the user to walk, a first lever configured to move between a first position and a second position of the first lever, the first lever being configured to actuate the tightening means, the first lever comprising at least one manipulation surface configured to allow a user to move the first lever from the first position of the first lever to the second position of the first lever, wherein the first lever is connected to the tightening means so that:

when the first lever is in the first position of the first lever, a cuff of the sports shoe or boot is in a tightened state around the lower leg of the user and/or a lower shell of the sports shoe or boot is in a tightened state around the foot of the user, and when the first lever is in the second position of the first lever, the cuff is not in the tightened state around the lower leg of the user and/or the lower shell is not in the tightened state around the foot of the user, a second lever distinct from the first lever, the second lever being configured to move between a first position and a second position of the second lever, the second lever being configured to actuate the at least one accessory of the sports shoe or boot independently from the tightening means, the second lever comprising at least one manipulation surface configured to allow the user to move the second lever from the first position of the second lever to the second position of the second lever, wherein the second lever is connected to the accessory so that:

when the second lever is in the first position of the second lever, the accessory is not configured to make it easier for the user to walk, and when the second lever is in the second position of the second lever, the accessory is configured to make it easier for the user to walk, wherein the first lever and the second lever are configured to rest one upon the other, wherein at least one of:

(i) the first lever is configured to rest upon the second lever, so that when the first lever is in the first position of the first lever, the second lever is automatically in the first position of the second lever, and when the second lever is in the second position of the second lever, the first lever is automatically in the second position of the first lever, wherein the second lever is configured to actuate the accessory independently from the tightening means when the first lever is in the second position of the first lever, or (ii) the second lever is configured to rest upon the first lever, so that when the second lever is in the first position of the second lever, the first lever is automatically in the first position of the first lever, and when the first lever is in the second position of the first lever, the second lever is automatically in the second position of the second lever, wherein the second lever is configured to actuate the accessory independently from the tightening means when the first lever is in the first position of the first lever.

25. The operating device according to claim 24, wherein the first lever is configured to rest upon the second lever, so that when the first lever is in the first position of the first lever, the second lever is automatically in the first position of the second lever, and when the second lever is in the second position of the second lever, the first lever is automatically in the second position of the first lever, wherein the second lever is configured to actuate the accessory independently from the tightening means when the first lever is in the second position of the first lever.

26. The operating device according to claim 24, wherein the second lever is configured to rest upon the first lever, so that when the second lever is in the first position of the second lever, the first lever is automatically in the first position of the first lever, and when the first lever is in the second position of the first lever, the second lever is automatically in the second position of the second lever, wherein the second lever is configured to actuate the accessory independently from the tightening means when the first lever is in the first position of the first lever.

* * * * *